US007023460B2

(12) United States Patent
Kaerts et al.

(10) Patent No.: US 7,023,460 B2
(45) Date of Patent: Apr. 4, 2006

(54) THERMAL HEAD PRINTER AND PROCESS FOR PRINTING SUBSTANTIALLY LIGHT-INSENSITIVE RECORDING MATERIAL

(75) Inventors: Eric Kaerts, Mortsel (BE); Ivan Hoogmartens, Mortsel (BE); Geert Defieuw, Mortsel (BE)

(73) Assignee: Agfa Gevaert, Mortsel (BE)

( * ) Notice: Subject to any disclaimer, the term of this patent is extended or adjusted under 35 U.S.C. 154(b) by 16 days.

(21) Appl. No.: 10/692,479

(22) Filed: Oct. 24, 2003

(65) Prior Publication Data

US 2004/0090518 A1 May 13, 2004

Related U.S. Application Data

(60) Provisional application No. 60/430,436, filed on Dec. 3, 2002.

(30) Foreign Application Priority Data

Nov. 13, 2002 (EP) ..... 02102569

(51) Int. Cl.
*B41J 2/315* (2006.01)

(52) U.S. Cl. ..... 347/171

(58) Field of Classification Search ..... 347/171, 347/188, 200, 202, 204, 207, 208, 211; 400/120, 400/120.09, 120.01

See application file for complete search history.

(56) References Cited

U.S. PATENT DOCUMENTS 4,679,053 A 7/1987 Katsurai et al.

(Continued)

FOREIGN PATENT DOCUMENTS

EP 0 500 334 A2 8/1992

(Continued)

OTHER PUBLICATIONS

Search Report for EP 02 10 2569 (Apr. 16, 2003).

*Primary Examiner*—K. Feggins
(74) *Attorney, Agent, or Firm*—Leydig, Voit & Mayer, Ltd

(57) ABSTRACT

A thermal head printer for printing but not perforating a substantially light-insensitive thermographic material, the thermal printer comprising: a transport system having a transport direction, n thermal heads, where n is an integer, each of the thermal heads comprising an array of substantially rectangular energizable heating elements, the heating elements having a length $L_n$ in the transport direction and a pitch $P_n$ between adjacent heating elements, and a means for supplying electrical energy to each of the substantially rectangular energizable heating elements in at least one of the thermal heads, the transport system being capable of transporting the light-insensitive thermographic material in contact or proximity with at least one of the thermal heads, wherein at least one of the thermal heads comprises heating elements for which $L_n/P_n$ is between 0.25 and 0.88; a first process for printing a substantially light-insensitive thermographic material with the above-described thermal head printer; a second process for printing a substantially light-insensitive thermographic material at different printing speeds with a thermal head comprising heating elements without significant variation in image tone, wherein the length of the heating elements in the transport direction of the substantially light-insensitive thermographic material decreases with decreasing printing speed; and a third process for printing a substantially light-insensitive thermographic material at different printing speeds with a different thermal head at each printing speed without significant variation in image tone, wherein each of said different thermal heads comprises heating elements with a different length in the transport direction of the substantially light-insensitive thermographic material and the length of the heating elements in the transport direction of the substantially light-insensitive thermographic material decreases with decreasing printing speed.

16 Claims, 1 Drawing Sheet

U.S. PATENT DOCUMENTS

| | | | |
|---|---|---|---|
| 4,841,120 | A | 6/1989 | Yagino et al. |
| 4,970,530 | A | 11/1990 | Takeda |
| 5,376,952 | A | 12/1994 | Kokubo et al. |
| 5,483,274 | A | 1/1996 | Inoue et al. |
| 5,485,193 | A | 1/1996 | Inoue et al. |
| 5,559,546 | A | 9/1996 | Sato |
| 5,729,274 | A | 3/1998 | Sato |
| 5,825,395 | A | 10/1998 | Fukuda |

FOREIGN PATENT DOCUMENTS

| | | | |
|---|---|---|---|
| EP | 1 006 000 | A1 | 6/2000 |
| EP | 1 006 403 | A1 | 6/2000 |
| EP | 1 006 404 | A1 | 6/2000 |
| EP | 1 080 924 | A1 | 3/2001 |
| JP | 58-089385 | A | 5/1983 |
| JP | 60-000984 | A | 1/1985 |
| JP | 61-086271 | A | 5/1986 |

THERMAL HEAD PRINTER AND PROCESS FOR PRINTING SUBSTANTIALLY LIGHT-INSENSITIVE RECORDING MATERIAL

CROSS-REFERENCE TO RELATED PATENT APPLICATIONS

This application claims the benefit of U.S. Provisional Application No. 60/430,436 filed Dec. 3, 2002, which is incorporated by reference. In addition, this application claims the benefit of European Application No. 02102569.7 filed Nov. 11, 2002, which is also incorporated by reference.

FIELD OF THE INVENTION

The present invention concerns a thermal head printer and process for printing substantially light-insensitive recording materials.

BACKGROUND OF THE INVENTION

Thermography is an image-forming process including a heating step and hence includes photothermography in which the image-forming process includes image-wise exposure and direct thermal processes in which the image-forming process includes an image-wise heating step. In direct thermal printing a visible image pattern is produced by image-wise heating of a recording material e.g. image signals can be converted into electric pulses and then via a driver circuit selectively transferred to a thermal head, which consists of microscopic heat resistor elements, thereby converting the electrical energy into heat via the Joule effect. This heat brings about image formation in the substantially light-insensitive thermographic material. In thermal heads, only those regions which produce heat higher than a certain value are effective for printing, and the regions capable of generating sufficient heat for the printing spread in proportion to voltage applied to the heating resistors. If, therefore, higher voltage is applied to the heating resistors, the size of the printing dots increases in proportion.

U.S. Pat. No. 5,825,395 discloses a printing system, comprising: a thermal head, color thermal recording paper having a surface with a plurality of different color developing layers disposed thereon, said plurality of different color developing layers corresponding to a plurality of different colors, and means for feeding said color thermal recording paper in a feed direction at a feed pitch; said thermal head producing printed dots in a desired color developing layer over said surface of said color thermal coloring paper by selectively and directly heating said color thermal recording paper; said thermal head comprising an array of a predetermined number of heating elements, each of said heating elements having a length, in said feed direction of said color thermal recording paper, and being controllable to radiate a selected level of thermal energy, said array being operationally disposed with respect to said color thermal recording paper so that said selected level of thermal energy radiated by said each heating element produces one of said dots without damaging said color thermal recording paper; and said length of each heating element having a value of from 2 to 3.5 said feed pitch. The feed pitch is defined in U.S. Pat. No. 5,825,395 as the distance between adjacent image density peaks in the feed direction as can be seen from FIG. 4 and heating element lengths in the feed direction of 260 μm, 310 μm, 360 μm, 460 μm and 560 ∞m are disclosed therein, which according to the specification are longer than those in the case of conventional thermal heads. No information is provided with respect to distance between adjacent heating elements.

EP-A 0 500 334 discloses a thermal recording device for forming an image with a dot matrix by applying a thermal head consisting of heat emitting elements arranged in a single row at a first pitch along a primary scanning direction onto a surface of a thermal recording material and moving said thermal recording material relative to said thermal head in a secondary direction perpendicular to said primary scanning direction, and selectively heating said heat emitting elements for each successive movement of said thermal recording material at a second pitch in said scanning direction, wherein: a ratio of a length of said heating elements of said thermal head in said primary scanning direction to said first pitch is 30 to 70%, and a ratio of a length of each of said heat emitting elements of said thermal head in said secondary scanning direction to said second pitch is 60 to 95%. Embodiments 1, 4 and 7 and Examples 1 and 4 disclose aspect ratios, a/b, where a and b are the lengths of each heat emitting element in the primary and secondary directions, respectively, the primary direction corresponding to the lateral direction of the paper or direction of the row of heat emitting elements as shown in FIG. 2, of 60/25 (=2.4), 60/35 (=1.71), 60/44 (=1.36), 60/53 (=1.13) and 85/44 (=1.93) respectively. FIG. 2 also shows that the pitch in the primary direction, $P_a$, is the distance between the centre of one heat-emitting element and the centre of the next heat-emitting element in the primary direction. Embodiments 1, 4 and 7 and Examples 1 and 4 disclose $b/P_a$ ratios of 60/63.5 (=0.94), 60/63.5 (=0.94), 60/63.5 (=0.94), 60/63.5 (=0.94) and 85/63.5 (=1.34) respectively. $P_b$ is the dot pitch of the matrix in the secondary direction.

U.S. Pat. No. 5,559,546 discloses a method of perforating a heat sensitive stencil, the method comprising the steps of: bringing the heat sensitive stencil into contact with a thermal head having a plurality of heating resistors arranged in a row; moving the heat sensitive stencil in a sub-scanning direction which is orthogonal to a main-scanning direction in which the plurality of heating resistors are arranged; and perforating the heat sensitive stencil in a dot matrix shape with selectively heated heating resistors of said plurality of heating resistors; the method further comprising the further steps of: making the heat sensitive stencil of substantially only a thermoplastic resin film; and making a width of a space between two adjacent heat resistors of said plurality of heating resistors in the main scanning direction 30% or more of a pitch between the two adjacent heating resistors in the main scanning direction so as to regulate a width of a non-perforated portion of the heat sensitive stencil between two adjacent perforations in the main scanning direction to be 20% or more of the pitch between the two adjacent heating resistors in the main-scanning direction. The ratio of b, the length of the heating resistor in the sub-scanning direction, to the pitch Pa between two adjacent resistors in the main scanning direction in the Example according to Embodiment 1 is 40/63.5 (=0.63) and those of Comparative Examples A and B are both 60/63.5 (=0.94).

JP 58-089385A discloses the obtaining of a constant print density all the time even when thermal heads are exchanged by a method in which the same resistor elements as heating elements are provided to the thermal head having plural resistor heating elements, and on the basis of the resistance values of the elements, applied voltage is controlled. A resistor element 5 made of the same material as that of a heating resistor element 2 is provided to part of a thermal head in which heating resistor elements 2-1~2-7 are provided on a ceramic base plate 1, and also the resistor element 5 is connected to the terminals Ra and Rb of a constant-voltage regulation circuit through a lead pattern. When connecting a thermal head in which the resistance value of the heating element is lower than that of standard heating element, the base voltage of a transistor Tr2 rises because the resistance value of the resistor element 5 is also lower than standard, and therefore, collector current is increased and the voltage drop of the resistor R1 is increased. By this, the impedance between the collector bases of the transistor Tr1 is increased and output voltage Vout becomes lower than standard. When the resistance value of the heating element 2 is high, the output voltage also becomes higher.

U.S. Pat. No. 4,841,120 discloses a thermal head for recording on a recording medium comprising: a substrate having a thick portion and a thin portion having a first flat surface and a second surface formed on an opposite side of said substrate from said first flat surface, said second surface being adapted to contact said recording medium, a plurality of heat resistor elements formed on said first flat surface of said thin portion of said substrate, wiring circuit means for said heat resistor elements formed on said first flat surface of said substrate and driving means for driving said heat resistor elements formed by said first flat surface of said substrate, said thin portion being made by grinding said second surface of said substrate. FIGS. 7 and 8 illustrate split resistors.

JP 61-086271A discloses the elimination of the need to provide an interpolation line even at the time of high-speed recording, by a construction wherein the first and the second heating dot group are provided on the same substrate, and the two systems of the heating dot group are selectively used in accordance with recording condition, i.e., high resolution recording or high-speed recording. The first and third feeder lines 3, 19 and the second and fourth feeder lines 4,20 are so provided as to clamp respectively both side parts of a heating resistor 2 therebetween, and two heating dots 17, 18 differing in length are provided on the same substrate. In high-resolution recording, the first heating dot 17 is selectively operated for recording by using the first and second feeder lines 3,4 whereas in high-speed recording, the second heating dot is selectively operated for recording by using the third and fourth feeder lines 19,20.

U.S. Pat. No. 5,485,193 discloses a line-type thermal head for half-tone printing which expresses various densities by utilizing printing dots of various sizes, the thermal head having a main scanning axis and comprising: a substrate, a plurality of heating elements arranged on a substrate along the main scanning axis, each of the heating elements including at least one non-rectangular parallelogramatic resistor for generating heat; and means for supplying electric energy, an amount of which corresponds to a size of a printing dot to be recorded, to each of the heating elements to make the resistor generate heat, wherein the resistor has a region which generates sufficient heat for recording the printing dot, and a size of the region is changed in response to the amount of electric energy applied to the resistor so that printing dots having various sizes are produced by each of the resistors, the supply means including lead electrodes connected electrically to one pair of opposite sides of the resistor, each of the lead electrodes having a width not less than a length of one side of the one pair of opposite sides of the resistor; wherein a ratio of the length of one side of the one pair of opposite sides of the resistor to that of one side of another pair of opposite sides of the resistor is not greater than 1.5 and an acute angle formed by two sides of the one and another pair of opposite sides of the resistor is no more than 45° C.

U.S. Pat. No. 5,483,274 discloses a thermal head for a thermal recording apparatus, comprising: means for recording a continuous line of elliptic dots on a recording sheet, said means including a plurality of heat generation resistors arranged one-dimensionally along a given direction, each of the heat generation resistors formed to have a parallelogram shape including-four sides and two diagonal lines and configured such that the four sides of the parallelogram shape have directions crossing the given direction and such that two diagonal lines extending between opposing corners of the parallelogram have directions crossing the given direction; and a plurality of drive electrodes respectively connected to said heat generation resistors; wherein an ink film and the recording sheet for thermal recording, which are stacked on one another, are brought into contact with said heat generation resistors and moved in a direction orthogonal to the given direction along which said heat generation resistors are arranged and, during this movement, ink coated on the ink film is melted by said heat generation resistors to allow and image to be transferred to the recording sheet.

U.S. Pat. No. 4,970,530 discloses a thermal head arranged in a printing device so as to be opposite to a printed object fed in a constant direction, the thermal head comprising: a base member, a plurality of heating resistors arranged in said base member; electrodes disposed in said base member corresponding to said heating resistors; and a slit formed on a surface of said heating resistors and having a shape in which the width of the slit in a feeding direction of said printed object is less than that in an arranging direction of said heating resistors perpendicular to said feeding direction and the width of the slit in the arranging direction of the heating resistors is approximately equal to a half length of a pitch of said resistors in said arranging direction thereof.

Conventional thermal heads, such as used in the thermal head printers manufactured by AGFA-GEVAERT N.V. e.g. DRYSTAR™ 2000, DRYSTAR™ 3000 and DRYSTAR™ 4500, have a ratio of heating element length in the transport direction, L, to the pitch, P, between adjacent heating elements, the so-called aspect ratio L/P, of between 1.5 and 1.80. The thermal head disclosed in EP-A 1 006 000, EP-A 1 006 403 and EP-A 1 006 404 had heating elements with dimensions 85 μm×85 μm i.e. an aspect ratio L/P of 1.0.

There is a need for using a given substantially light-insensitive thermographic material developed for high throughput with a conventional thermal head for printing at lower throughputs without a significant change in image tone and other imaging properties.

ASPECTS OF THE INVENTION

It is therefore an aspect of the present invention to provide a thermal head printer for printing a substantially light-insensitive thermographic material with a particular image tone with printing configurations with different printing speeds.

It is therefore a further aspect of the present invention to provide a process for printing a substantially light-insensitive thermographic material at different printing speeds with a thermal head comprising heating elements without significant variation in image tone.

Further aspects and advantages of the invention will become apparent from the description hereinafter.

SUMMARY OF THE INVENTION

It has been surprisingly found that variation in the length of the resistive elements of a thermal head in the transport direction of a substantially light-insensitive thermographic material can be used to realize a particular image tone as characterized by CIELAB a* and b* values at different printing speeds with the same substantially light-insensitive thermographic material. The L*, a* and b* CIELAB-values were determined by spectrophotometric measurements according to ASTM Norm E179-90 in a R(45/0) geometry with evaluation according to ASTM Norm E308-90.

The above-mentioned aspects are realised by a thermal head printer for printing but not perforating a substantially light-insensitive thermographic material, the thermal printer comprising: a transport system having a transport direction, n thermal heads, where n is an integer, each of the thermal heads comprising an array of substantially rectangular energizable heating elements, the heating elements having a length $L_n$ in the transport direction and a pitch $P_n$ between adjacent heating elements, and a means for supplying electrical energy to each of the substantially rectangular energizable heating elements in at least one of the thermal heads, the transport system being capable of transporting the light-insensitive thermographic material in contact or proximity with at least one of the thermal heads, wherein at least one of the thermal heads comprises heating elements for which $L_n/P_n$ is between 0.25 and 0.88.

The above-mentioned aspects are also realized by a first process for printing a substantially light-insensitive thermographic material with the above-described thermal head printer comprising the steps of: choosing a thermal head, providing the substantially light-insensitive thermographic material, transporting the substantially light-insensitive thermographic material past the thermal head, and image-wise heating of the substantially light-insensitive thermographic material by supplying electrical energy to the heating elements.

The above-mentioned aspects are further realized by a second process for printing a substantially light-insensitive thermographic material at different printing speeds with a thermal head comprising heating elements without significant variation in image tone, wherein the length of the heating elements in the transport direction of the substantially light-insensitive thermographic material decreases with decreasing printing speed.

Aspects of the present invention are also realized by a third process for printing a substantially light-insensitive thermographic material at different printing speeds with a different thermal head at each printing speed without significant variation in image tone, wherein each of the different thermal heads comprises heating elements with a different length in the transport direction of the substantially light-insensitive thermographic material and the length of the heating elements in the transport direction of the substantially light-insensitive thermographic material decreases with decreasing printing speed.

Preferred embodiments of the present invention are disclosed in the detailed description of the invention.

DETAILED DESCRIPTION OF THE INVENTION

The present invention will be described in greater detail in the following with reference to the accompanying drawings, wherein.

DEFINITIONS

The L*, a* and b* CIELAB-values are defined in ASTM Norm E179-90 in a R(45/0) geometry with evaluation according to ASTM Norm E308-90.

A heating element as used in disclosing the present invention is a resistor, which becomes hot upon being energized.

Figure 2:
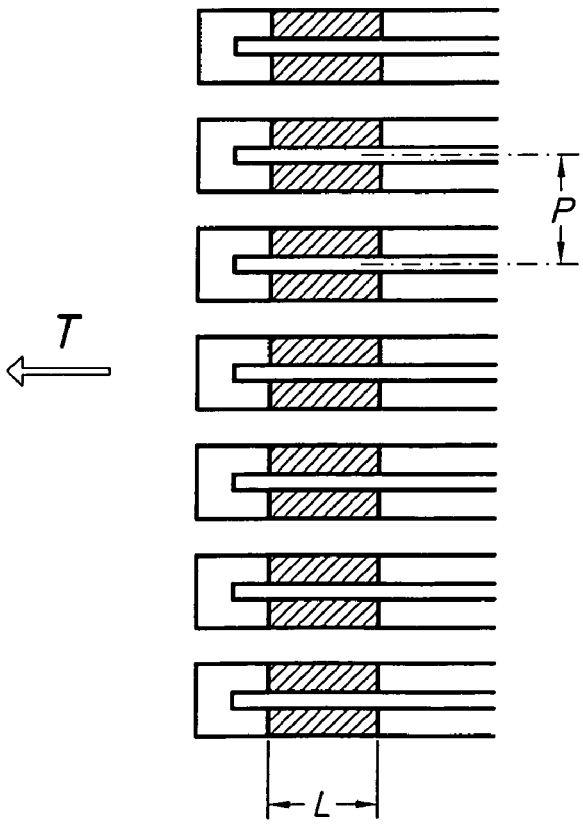
FIG. 2 is a schematic representation of an array of substantially rectangular split resistor heating elements with a length, L, in the transport direction, T, and a pitch, P.

A split resistor, see FIG. 2, is a U-shaped heating element with the arms of the U parallel to the transport direction of the substantially light-insensitive recording material, which enables contacts to be made at the same side of the thermal head.

The spatial resolution of a thermal head, or thermal head resolution, is the number of lines that can be distinguished in an image on a thermographic material expressed in lines or dots per unit length e.g. in lines/mm or dots/mm, or in dots per inch (dpi).

Figure 1:
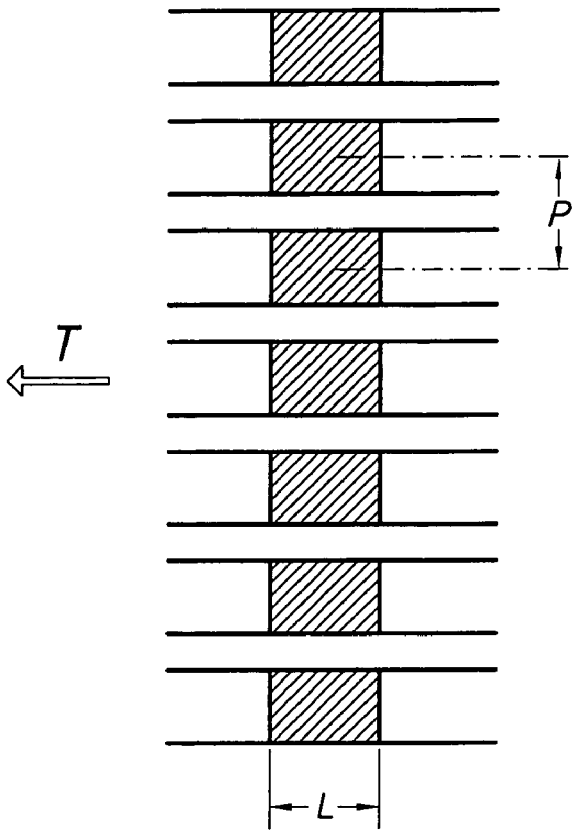
FIG. 1 is a schematic representation of an array of conventional substantially rectangular heating elements with a length, L, in the transport direction, T, and a pitch, P.

The thermal head pitch, P, is the distance between the geometric middle of one heating element and the geometric middle of an adjacent heating element along a line in the plane of the heating elements which bisects all the heating elements (see FIGS. 1 and 2). This line is lateral to the transport direction of the substantially light-insensitive recording material. In the case of split resistor, the geometric middle may be in the gap between the two arms of the split resistor (see FIG. 2).

The heating element aspect ratio is the length of the heating element in the transport direction, T, of the substantially light-insensitive recording material L (see FIGS. 1 and 2) divided by the thermal head pitch P (see FIGS. 1 and 2).

The line time is the time taken to print one line lateral to the transport direction of the substantially light-insensitive recording material i.e. at an angle to the transport direction of 90°±20°.

Transport speed, i.e. the speed of the substantially light-insensitive thermographic material, is the distance between adjacent lines of image dots in the transport direction divided by the line time.

A transport system can consist of a moving belt, motor-driven drums, capstans etc.

Substantially rectangular means having angles which deviate from 90° by no more than 20°.

Substantially light-insensitive means not intentionally light sensitive.

The descriptor aqueous in the term aqueous medium for the purposes of the present invention includes mixtures of water-miscible organic solvents such as alcohols e.g. methanol, ethanol, 2-propanol, butanol, iso-amyl alcohol etc.; glycols e.g. ethylene glycol; glycerine; N-methyl pyrrolidone; methoxypropanol; and ketones e.g. 2-propanone and 2-butanone etc. with water in which water constitutes more than 50% by weight of the aqueous medium with 65% by weight of the aqueous medium being preferred and 80% by weight of the aqueous being particularly preferred.

A leuco-dye is a colourless or weakly coloured compound derived from a dye. Colourless or light coloured dye precursor leuco-dye systems include leuco triarylmethane, indolyl phthalide, diphenylmethane, 2-anilinofluoran, 7-anilinofluoran, xanthene and spiro compounds such as disclosed in EP-A 754 564.

Thermal Head Printer

Aspects of the present invention are realised by a thermal head printer for printing but not perforating a substantially light-insensitive thermographic material, the thermal printer comprising: a transport system having a transport direction, n thermal heads, where n is an integer, each of the thermal heads comprising an array of substantially rectangular energizable heating elements, the heating elements having a length $L_n$ in the transport direction and a pitch $P_n$ between adjacent heating elements, and a means for supplying electrical energy to each of the substantially rectangular energizable heating elements in at least one of the thermal heads, the transport system being capable of transporting the light-insensitive thermographic material in contact or proximity with at least one of the thermal heads, wherein at least one of the thermal heads comprises heating elements for which $L_n/P_n$ is between 0.25 and 0.88. The thermal head can be associated with one or more further thermal heads each with an array of heating elements having a length $L_n$ in the transport direction and a pitch $P_n$ between adjacent heating elements. These thermal heads may be staggered or butted.

According to a first embodiment of the thermal head printer, according to the present invention, the thermal head printer comprises a replaceable thermal head or set of thermal heads.

According to a second embodiment of the thermal head printer, according to the present invention, the thermal head printer comprises at least two thermal heads, configured such that a first thermal head can be replaced by an nth thermal head while being capable of maintaining a comparable image tone with said substantially light-insensitive thermographic material.

According to a third embodiment of the thermal head printer, according to the present invention, the substantially rectangular heating element is a split resistor.

According to a fourth embodiment of the thermal head printer, according to the present invention, the heating elements are exclusive of a slit formed on a surface of the heating elements and having a shape in which the width of the slit in a feeding direction of the printed object is less than that in an arranging direction of the heating elements perpendicular to the feeding direction and the width of the slit in the arranging direction of the heating elements is approximately equal to a half length of a pitch of the heating elements in the arranging direction thereof.

According to a fifth embodiment of the thermal head printer, according to the present invention, said heating elements of at least one thermal head have a length, $L_n$, in the transport direction of less than 88 μm.

According to a sixth embodiment of the thermal head printer, according to the present invention, said heating elements of at least one thermal head have a pitch, $P_n$, of less than 100 μm.

According to a seventh embodiment of the thermal head printer, according to the present invention, at least one of the thermal heads comprises heating elements for which $L_n/P_n$ is between 0.40 and 0.75.

According to an eighth embodiment of the thermal head printer, according to the present invention, at least one of the thermal heads comprises heating elements with a width of a space between adjacent resistors along a line in the plane of the heating elements which bisects all the heating elements which is 20% or less and preferably 15% or less of the pitch, $P_n$, between two adjacent heating elements.

The line time has been defined above as the time taken to print one line lateral to the transport direction of the substantially light-insensitive recording material i.e. at an angle to the transport direction of 90°±20°. It should be pointed out that for a particular transport speed and for heating elements with a particular dimension, the image tone attained for printed pixels with a length in the transport direction no larger than the length of the heating element in the transport direction does not depend upon the line time, since varying the line-time simply results in a variation in the length of the printed pixel in the transport direction, the length of the printed pixel being proportional to the line-time.

According to a ninth embodiment of the thermal head printer, according to the present invention, said heating elements are thin film heating elements.

According to a tenth embodiment of the thermal head printer, according to the present invention, said heating elements are connected to the means of supplying electrical energy on the same side of the heating elements.

Processes for Printing a Substantially Light-insensitive Thermographic Material Aspects of the present invention are realized by a first process for printing a substantially light-insensitive thermographic material with the above-described thermal head printer comprising the steps of: choosing a thermal head, providing the substantially light-insensitive thermographic material, transporting the substantially light-insensitive thermographic material past the thermal head, and image-wise heating of the substantially light-insensitive thermographic material by supplying electrical energy to the heating elements.

Aspects of the present invention are also realized by a second process for printing a substantially light-insensitive thermographic material at different printing speeds with a thermal head comprising heating elements without significant variation in image tone, wherein the length of the heating elements in the transport direction of the substantially light-insensitive thermographic material decreases with decreasing printing speed.

Aspects of the present invention are also realized by a third process for printing a substantially light-insensitive thermographic material at different printing speeds with a different thermal head at each printing speed without significant variation in image tone, wherein each of said different thermal heads comprises heating elements with a different length in the transport direction of the substantially light-insensitive thermographic material and said length of the heating elements in the transport direction of the substantially light-insensitive thermographic material decreases with decreasing printing speed.

It has been surprisingly found that with a particular substantially light-insensitive thermographic material a constant image tone can be realized at different transport speeds of the substantially light-insensitive thermographic material by changing the length of the heating element in the transport direction e.g. if the transport speed is reduced the same image tone can be realized by reducing the length of the heating element in the transport direction.

The operating temperature of common thermal heads is in the range of 300 to 400° C. and the pressure contact of the thermal printhead with the recording material to ensure a good transfer of heat being e.g. 200–1000 g/linear cm i.e.

with a contact zone (nip) of 200 to 300 μm a pressure of 5000 to 50,000 g/cm$^2$. Activation of the heating elements can be power-modulated or pulse-length modulated at constant power.

According to a first embodiment of the first process, the first embodiment of the second process and a first embodiment of the third process, according to the present invention, at least one thermal head has a line-time of less than 20 ms.

According to a second embodiment of the second process and a second embodiment of the third process, according to the present invention, the second process excludes a perforation step.

According to a third embodiment of the second process and a third embodiment of the third process, according to the present invention, the thermal heads are each on a different substrate.

Substantially Light-insensitive Thermographic Material

The term substantially light-insensitive thermographic material includes all materials which produce a change in optical density upon the application of heat.

According to a second embodiment of the processes, according to the present invention, the substantially light-insensitive thermographic material is a black and white material.

According to a third embodiment of the processes, according to the present invention, the substantially light-insensitive thermographic material is a two sheet material in which an ingredient necessary for the image-forming process is transferred upon image-wise application of heat from one sheet to the other where it reacts with one or more further ingredients to produce an image.

According to a fourth embodiment of the processes, according to the present invention, the substantially light-insensitive thermographic material is a monosheet material.

According to a fifth embodiment of the processes, according to the present invention, the substantially light-insensitive thermographic material contains a thermosensitive element comprising one or more layer, the one or more layers containing an image-forming system.

Suitable image-forming systems include monosheet substantially light-insensitive thermographic materials such as colourless or light coloured dye precursor leuco-dye systems, as disclosed in U.S. Pat. No. 4,370,370, EP-A 479 578 and EP-A 754 564, diazo systems, as disclosed in JP 60-01077A, or two-sheet thermal dye transfer systems, such as disclosed in EP-A 656 264 and U.S. Pat. No. 4,943,555. Alternatively the image-forming systems may comprise at least one substantially light-insensitive organic silver salt and at least one organic reducing agent therefor either in a two-sheet material in which upon image-wise application of heat at least one organic reducing agent is image-wise transferred to a sheet containing the at least one substantially light-insensitive organic silver salt whereupon the image-forming reaction takes place or in a monosheet material in which the at least one substantially light-insensitive organic silver salt is in thermal working relationship with the at least one organic reducing agent therefor.

In a sixth embodiment of the processes, according to the present invention, the substantially light-insensitive thermographic material is a monosheet material comprising a thermosensitive element and a support, the thermosensitive element comprising at least one substantially light-insensitive organic silver salt, at least one organic reducing agent therefor in thermal working relationship therewith, i.e. during the thermal development process the organic reducing agent must be present in such a way that it is able to diffuse to the substantially light-insensitive organic silver salt particles so that reduction of the substantially light-insensitive organic silver salt can take place, and a binder. Such materials include the possibility of one or more substantially light-insensitive organic silver salts and/or one of more organic reducing agents therefor being encapsulated in heat-responsive microcapsules, such as disclosed in EP-A 0 736 799 herein incorporated by reference.

Organic Silver Salts

Preferred substantially light-insensitive organic silver salts for use in the thermosensitive element of the substantially light-insensitive elongated imaging material used in the present invention, are silver salts of aliphatic carboxylic acids known as fatty acids, wherein the aliphatic carbon chain has preferably at least 12 C-atoms, which silver salts are also called silver soaps.

Organic Reducing Agents

Suitable organic reducing agents for the reduction of the substantially light-insensitive organic silver salts are organic compounds containing at least one active hydrogen atom linked to O, N or C. The choice of reducing agent influences the thermal sensitivity of the imaging material and the gradation of the image. Imaging materials using gallates, for example, have a high gradation. In a preferred embodiment of the present invention the thermosensitive element contains a 3,4-dihydroxyphenyl compound with ethyl 3,4-dihydroxybenzoate, n-butyl 3,4-dihydroxybenzoate, 3,4-dihydroxy-benzophenone and 3,4-dihydroxy-benzonitrile being particularly preferred.

Binder

The thermosensitive element of the substantially light-insensitive elongated imaging material used in the present invention may be coated onto a support in sheet- or web-form from an organic solvent containing the binder dissolved therein or may be applied from an aqueous medium using water-soluble or water-dispersible binders.

Suitable binders for coating from an organic solvent are all kinds of natural, modified natural or synthetic resins or mixtures of such resins, wherein the organic heavy metal salt can be dispersed homogeneously or mixtures thereof.

Suitable water-soluble film-forming binders include: polyvinyl alcohol, polyacrylamide, polymethacrylamide, polyacrylic acid, polymethacrylic acid, polyethyleneglycol, polyvinylpyrrolidone, proteinaceous binders such as gelatin and modified gelatins, such as phthaloyl gelatin, polysaccharides, such as starch, gum arabic and dextrin, and water-soluble cellulose derivatives. Suitable water-dispersible binders are any water-insoluble polymers. Poly(vinylbutyral) is the preferred binder.

In the case of substantially light-insensitive thermographic recording materials containing substantially light-insensitive organic silver salts, the binder to organic silver salt weight ratio decreases the gradation of the image increasing. Binder to organic silver salt weight ratios of 0.2 to 6 are preferred with weight ratios between 0.5 and 3 being particularly preferred.

The above mentioned binders or mixtures thereof may be used in conjunction with waxes or "heat solvents" to improve the reaction speed of the image-forming reaction at elevated temperatures.

Toning Agents

In order to obtain a neutral black image tone in the higher densities and neutral grey in the lower densities, the substantially light-insensitive thermographic material used in the present invention may contain one or more toning agents. In the case of substantially light-insensitive thermographic recording materials containing substantially light-insensitive organic silver salts, the toning agents should be in thermal working relationship with the substantially light-insensitive organic silver salt and reducing agents during thermal processing.

Suitable toning agents are described in U.S. Pat. Nos. 3,074,809, 3,446,648 and 3,844,797 and 4,082,901. Other particularly useful toning agents are the heterocyclic toning compounds of the benzoxazine dione or naphthoxazine dione type as disclosed in GB 1,439,478, U.S. Pat. Nos. 3,951,660 and 5,599,647.

According to an seventh embodiment of the process, according to the present invention, the substantially light-insensitive thermographic material contains a thermosensitive element, the thermosensitive element containing one or more toning agents selected from the group consisting of phthalazinone, benzo[e][1,3]oxazine-2,4-dione, 7-methyl-benzo[e][1,3]oxazine-2,4-dione, 7-methoxy-benzo[e][1,3]oxazine-2,4-dione and 7-(ethylcarbonato)-benzo[e][1,3]oxazine-2,4-dione.

Stabilizers and Antifoggants

In order to obtain improved shelf-life, archivability and reduced fogging, stabilizers and antifoggants may be incorporated into the substantially light-insensitive thermographic material used in the present invention. Suitable stabilizers compounds for use in the substantially light-insensitive thermographic material used in the present invention include benzotriazole, tetrachlorophthalic acid anhydride and those compounds represented by general formula I:

(I)

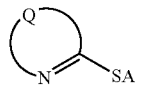

where Q are the necessary atoms to form a 5- or 6-membered aromatic heterocyclic ring, A is selected from hydrogen, a counterion to compensate the negative charge of the thiolate group or a group forming a symmetrical or an asymmetrical disulfide.

Surfactants and Dispersants

Surfactants and dispersants aid the dispersion of ingredients which are insoluble in the particular dispersion medium. The substantially light-insensitive thermographic material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Support

According to a eighth embodiment of the processes, according to the present invention, the substantially light-insensitive thermographic material has a transparent or translucent support and is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

In a preferred embodiment of the present invention a protective layer is provided for the thermosensitive element. In general this protects the thermosensitive element from atmospheric humidity and from surface damage by scratching etc. and prevents direct contact of printheads or other heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the substantially light-insensitive thermographic material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers. The following examples and comparative examples illustrate the present invention. The percentages and ratios used in the examples are by weight unless otherwise indicated.

Ingredients in the adhesion layers, Ad-L01 and Ad-L02:

| | |
|---|---|
| PEDOT/PSS= | 1.2% aqueous dispersion of a latex consisting of poly(3,4-ethylenedioxythiophene):poly (styrene-sulphonate) in a weight ratio of 1:2.46 |
| HOSTAPON T= | a 40% concentrate of a sodium salt of N-methyl-N-2-sulfoethyl-oleylamide by HOECHST; |
| LATEX01= | 30% aqueous dispersion of a copolymer of 88% vinylidene chloride, 10% methyl acrylate and 2% itaconic acid stabilized and 0.75% of HOSTAPON T |
| KIESELSOL ™ 100F= | a 30% aqueous dispersion of colloidal silica from BAYER; |
| MERSOLAT ™ H= | a 76% aqueous paste of a sodium pentadecyl-sulfonate from BAYER; |

-continued

| Ingredients in the backing layer, Ba-L: | |
|---|---|
| POVAL 103= | a 98% hydrolyzed poly(vinyl alcohol) powder from Kuraray; |
| boric acid= | $H_3BO_3$ |
| AKYPO ™ OP80= | an 80% concentrate of an octyl-phenyl-oxy-polyethyleneglycol(EO 8)acetic acid from CHEMY; |
| SNOWTEX ™ O= | a 20% aqueous dispersion of colloidal silica, from NISSAN CHEMICAL; |
| SUNSPHERE ™ H51= | a 8.63% dispersion of 5.7 μm silica particles from Asahi Glass; |

Ingredients in the thermosensitive element, Th-El:

| | |
|---|---|
| S-LEC BL5HP= | a polyvinyl butyral from SEKISUI; |
| BAYSILON= | a silicone oil from BAYER; |
| DESMODUR VL= | a 4,4'-diisocyanatodiphenylmethane from BAYER; |
| Reducing agents: | |
| R01= | 3,4-dihydroxybenzonitrile; |
| R02= | 3,4-dihydroxybenzophenone; |
| Toning agent: | |
| T01= | 7-methyl-benzo[e] [1,3]oxazine-2,4-dione; |
| Stabilizers: | |
| S01= | glutaric acid |
| S02= | tetrachlorophthalic acid anhydride |
| S03= | benzotriazole |

Ingredients in the protective layer, PRO-L:

| | |
|---|---|
| ERCOL ™ 48 20= | a polyvinylalcohol from ACETEX EUROPE; |
| LEVASIL ™ VP AC 4055= | a 15% aqueous dispersion of colloidal silica with acid groups predominantly neutralized with sodium ions and a specific surface are of 500 $m^2/g$, from BAYER AG has been converted into the ammonium salt; |
| ULTRAVON ™ W= | 75–85% concentrate of a sodium arylsulfonate from Ciba Geigy converted into acid form by passing through an ion exchange column; |
| SYLOID ™ 72= | a silica from Grace; |
| SERVOXYL ™ VPDZ 3/100= | a mono[isotridecyl polyglycolether (3 EO)]phosphate, from SERVO DELDEN B.V.; |
| SERVOXYL ™ VPAZ 100= | a mixture of monolauryl and dilauryl phosphate, from SERVO DELDEN B.V.; |
| MICROACE TALC P3= | an Indian talc from NIPPON TALC; |
| RILANIT ™ GMS= | a glycerine monotallow acid ester, from HENKEL AG |
| TMOS= | tetramethylorthosilicate hydrolyzed in the presence of methanesulfonic acid. |

COMPARATIVE EXPERIMENTS 1 & 2 AND INVENTION EXAMPLE 1

Substantially Light-insensitive Thermographic Material

The substantially light-insensitive thermographic material used in evaluating the thermal head printer and process for printing a substantially light-insensitive recording materials, according to the present invention, consisted of a blue-pigmented PET support coated on one side with adhesion layer Ad-L01 and on the other side with adhesion layer Ad-L02. The adhesion layer Ad-L01 was further coated with the thermosensitive element TH-EL which itself was further coated with a protective layer PRO-L. The adhesion layer Ad-L02 was further coated with backing layer Ba-L.

Coating Support with Adhesion Layers Ad-L01 and Ad-L02:

A 168 μm thick blue-pigmented polyethylene terephthalate film with CIELAB-L*, a* and −b* values of 85.5, −8.5 and −18.9 respectively and a density measured in transmission with a MacBeth™ TD924 densitometer through a visible filter of 0.195 was coated on one side with an aqueous dispersion with the following ingredients to produce an adhesion layer Ad-L01 with the composition:

| | |
|---|---|
| LATEX01= | 151 $mg/m^2$ |
| KIESELSOL ™ F= | 35 $mg/m^2$ |
| MERSOLAT ™ H= | 0.75 $mg/m^2$ |

and on the other side with an aqueous dispersion with the following ingredients to produce an antistatic adhesion layer Ad-L02 with the composition:

| | |
|---|---|
| PEDOT/PSS= | 2.58 $mg/m^2$ |
| LATEX01= | 147.3 $mg/m^2$ |
| KIESELSOL ™ F= | 16.4 $mg/m^2$ |
| sorbitol= | 24.7 $mg/m^2$ (partially evaporated) |
| MERSOLAT ™ H= | 0.74 $mg/m^2$ |

Preparation of Backing Layer Ba-L:

264 g of POVAL 103 was added to 1736 g of cold water. The temperature was increased to 95° C. and held at that temperature for 30 minutes. The resulting solution with a solids content of 13.2% by weight was cooled down to room temperature (25° C.). 2000 g of this polyvinyl alcohol solution was then added with mixing to 1067.6 g of deionized water and then 130.7 ml of a 5% by weight of an aqueous solution of AKYPO™ OP80 was added, followed by 1978.5 g of SNOWTEX™ O, Nissan Chemical and 45.85 g of SUNSPHERE™ H51. The resulting solution had a pH of 4.8. The pH of this solution was then adjusted to a pH of 3.5 with 1N nitric acid and finally 156 mL of 4% boric acid was added with stirring to produce the coating solution.

This coating solution was applied to a wet thickness of 40 μm to antistatic adhesion layer Ad-L02 on one side of the 168 μm thick blue-pigmented polyethylene terephthalate film. The film was then dried by an air flow with a temperature of 140° C. to produce a layer Ba-L with the composition:

| | |
|---|---|
| POVAL 103= | 2125 mg/m$^2$ |
| boric acid= | 50 mg/m$^2$ |
| AKYPO OP80= | 53 mg/m$^2$ |
| SNOWTEX ™ O= | 3166 mg/m$^2$ |
| SUNSPHERE ™ H51= | 32 mg/m$^2$ |

Preparation of Thermosensitive Element, Th-El:

The adhesion layer Ad-L01 on one side of the 168 μm thick blue-pigmented polyethylene terephthalate film was coated with a composition containing 2-butanone as solvent/dispersion medium to a wet layer thickness of 95 μm, so as to obtain thereon, after drying at 85° C. for 5 minutes, thermosensitive layer Th-El with the following composition:

| | |
|---|---|
| silver behenate = | 4.149 g/m$^2$ |
| S-LEC BL5HP = | 16.596 g/m$^2$ |
| T01 = | 0.246 g/m$^2$ |
| BAYSILON = | 0.037 g/m$^2$ |
| R01 = | 0.438 g/m$^2$ |
| R02 = | 0.894 g/m$^2$ |
| S01 = | 0.294 g/m$^2$ |
| S02 = | 0.130 g/m$^2$ |
| S03 = | 0.109 g/m$^2$ |
| Desmodur VL = | 0.185 g/m$^2$ |

Preparation of Protective Layer, PRO-L:

The thermosensitive element, Th-El, was then coated with an aqueous composition with the following ingredients, which was adjusted to a pH of 3.8 with 1N nitric acid, to a wet layer thickness of 85 μm and then dried at 40° C. for 15 minutes to produce a protective layer PRO-L with the composition:

| | |
|---|---|
| ERCOL ™ 48 20 = | 2.1 g/m$^2$ |
| LEVASIL ™ VP AC 4055 = | 1.05 g/m$^2$ |

-continued

| | |
|---|---|
| ULTRAVON ™ W = | 0.075 g/m$^2$ |
| SYLOID ™ 72 = | 0.09 g/m$^2$ |
| SERVOXYL ™ VPDZ 3/100 = | 0.075 g/m$^2$ |
| SERVOXYL ™ VPAZ 100 = | 0.075 g/m$^2$ |
| MICROACE TALC P3 = | 0.045 g/m$^2$ |
| RILANIT ™ GMS = | 0.15 g/m$^2$ |
| TMOS = | 0.87 g/m$^2$ (assuming that the TMOS was completely converted to $SiO_2$) |

After coating the protective layer was hardened by heating the substantially light-insensitive thermographic material at 50° C. for 7 days.

Printing Experiments

The substantially light-insensitive thermographic material was then printed with the printing conditions given in Table 1 for COMPARATIVE EXAMPLES 1 to 3 and INVENTION EXAMPLE 1 respectively.

It should be noted that, although some of the reported experiments were carried out with thermal heads giving a resolution of 320 dpi and others carried out with thermal heads giving a resolution of 508 dpi, substantially similar shifts in image tone with transport speed were observed regardless of the resolution at which the experiments were carried out.

TABLE 1

| | Comparative Example 1 | Comparative Example 2 | Comparative Example 3 | Invention Example 1 |
|---|---|---|---|---|
| printer | modified DRYSTAR ™ 3000 | prototype high throughput | prototype high throughput | prototype low throughput |
| resolution of thermal head | 320 dpi | 508 dpi | 508 dpi | 320 dpi |
| heating elements L × P | 140 μm × 79.4 μm | 75 μm × 50 μm | 75 μm × 50 μm | 50 μm × 79.4 μm# |
| aspect ratio of heating element | 1.76 | 1.50 | 1.50 | 0.63 |
| transport speed [mm/s] | 9.53 (vs 6.64*) | 14.3 | 7.15 | 9.53 (vs 6.64*) |
| line time | 11.95 ms | 3.5 ms | 7.0 ms | 8.33ms |
| distance travelled per line | 113.9 μm | 50 μm | 50 μm | 79.4 μm |

* standard transport speed for a DRYSTAR 3000 configuration
#split heating element with "arms" 24.7 μm wide and a gap of 15 μm Image Evaluation The density of the prints obtained in COMPARATIVE EXAMPLES 1 to 3 and INVENTION EXAMPLE 1, $D_{vis}$, was determined in transmission with a MacBeth™ TD924 densitometer using a visible filter and the image tone was evaluated as a function of the print density, $D_{vis}$, using CIELAB measurements. The L*, a* and b* CIELAB-values of the prints were determined by spectrophotometric measurements according to ASTM Norm E179-90 in a R(45/0) geometry with evaluation according to ASTM Norm E308-90.

In the CIELAB-system a negative CIELAB a*-value indicates a greenish image-tone becoming greener as a* becomes more negative, a positive a*-value indicating a reddish image-tone becoming redder as a* becomes more positive. A negative CIELAB b*-value indicates a bluish tone which becomes increasingly bluer as b* becomes more negative and a positive b*-value indicates a yellowish image-tone becoming more yellow as b* becomes more positive. In terms of the visual perception of an image as a whole, the image tone of elements of the image with a density of 1.0 have a stronger effect than the image tone of elements with lower or higher optical density.

Table 2 gives the CIELAB a*- and b*-values for optical densities, $D_{vis}$, between 0.2 and 2.8 for an AGFA-GEVAERT SCOPIX™ LT2B silver halide emulsion laser medical hardcopy film (reference hardcopy film) and for the substantially light-insensitive thermographic material printed according to COMPARATIVE EXPERIMENTS 1 and 2 and INVENTION EXPERIMENT 1.

TABLE 2

| | CIELAB a*-value | | | | CIELAB b*-value | | | |
|---|---|---|---|---|---|---|---|---|
| | SCOPIX ™ LT2B medical hardcopy | Comparative experiment | | Invention | SCOPIX ™ LT2B medical hardcopy | Comparative experiment | | Invention |
| $D_{vis}$ | film | 1 | 2 | experiment 1 | film | 1 | 2 | experiment 1 |
| 0.2 | −7.05 | −8.50 | −8.40 | −8.45 | −14.27 | −16.70 | −16.40 | −16.75 |
| 0.4 | −6.23 | −7.45 | −7.50 | −7.70 | −11.07 | −10.20 | −11.08 | −12.65 |
| 0.6 | −5.53 | −6.43 | −6.60 | −6.40 | −10.25 | −7.45 | −9.50 | −10.50 |
| 0.8 | −4.93 | −5.67 | −5.72 | −5.20 | −8.75 | −6.05 | −8.70 | −9.45 |
| 1.0 | −4.40 | −5.10 | −4.90 | −4.35 | −7.5 | −5.10 | −8.13 | −8.83 |
| 1.2 | −3.90 | −4.40 | −4.24 | −3.58 | −6.45 | −4.50 | −7.65 | −8.45 |
| 1.4 | −3.47 | −4.00 | −3.68 | −3.07 | −5.55 | −3.83 | −7.10 | −8.10 |
| 1.6 | −3.05 | −3.55 | −3.28 | −2.77 | −4.83 | −3.40 | −6.53 | −7.65 |
| 1.8 | −2.73 | −3.20 | −2.83 | −2.50 | −4.45 | −2.95 | −5.86 | −6.90 |
| 2.0 | −2.39 | −2.85 | −2.50 | −2.25 | −3.30 | −2.50 | −5.05 | −5.90 |
| 2.2 | −1.70 | −2.10 | −1.98 | −1.90 | −2.43 | −1.85 | −3.90 | −4.55 |
| 2.4 | −1.05 | −1.40 | −1.55 | −1.40 | −1.55 | −1.05 | −2.55 | −2.87 |
| 2.6 | −0.70 | −0.95 | −1.16 | −1.00 | −0.97 | −0.57 | −1.46 | −1.70 |
| 2.8 | −0.48 | −0.70 | −0.80 | −0.70 | −0.60 | −0.25 | −0.85 | −0.93 |

In considering the image tone of the prints produced with COMPARATIVE EXPERIMENT 2 and INVENTION EXPERIMENT 1 with the same substantially light-insensitive thermographic material, it should be borne in mind that if the substantially light-insensitive thermographic material was to be printed at half the speed i.e. a transport speed of 7.15 mm/s (corresponding to a line-time of 7 mm/s) using the same thermal head as used in COMPARATIVE EXPERIMENT 2 as in the case of COMPARATIVE EXPERIMENT 3, shifts of up to −0.70 were observed in the CIELAB a*-values and up to +3.70 were observed in the CIELAB b*-values (see Table 3) with respect to that observed in COMPARATIVE EXPERIMENT 2, the exact shifts being dependent upon $D_{vis}$, resulting in an unacceptable yellowish tinge to the image.

TABLE 3

| | CIELAB a*-value | | | | CIELAB b*-value | | | |
|---|---|---|---|---|---|---|---|---|
| | SCOPIX ™ LT2B medical | Comparative experiment | | | SCOPIX ™ LT2B medical | Comparative experiment | | |
| $D_{vis}$ | hardcopy film | 2 | 3 | Δ3 − 2 | hardcopy film | 2 | 3 | Δ3 − 2 |
| 0.2 | −7.05 | −8.40 | −9.10 | −0.70 | −14.27 | −16.40 | −13.7 | +2.70 |
| 0.4 | −6.23 | −7.50 | −7.67 | −0.17 | −11.07 | −11.08 | −10.10 | +0.98 |
| 0.6 | −5.53 | −6.60 | −6.68 | −0.08 | −10.25 | −9.50 | −7.90 | +1.60 |
| 0.8 | −4.93 | −5.72 | −5.95 | −0.23 | −8.75 | −8.70 | −6.50 | +2.20 |
| 1.0 | −4.40 | −4.90 | −5.30 | −0.40 | −7.5 | −8.13 | −5.43 | +3.70 |
| 1.2 | −3.90 | −4.24 | −4.70 | −0.46 | −6.45 | −7.65 | −4.60 | +3.05 |
| 1.4 | −3.47 | −3.68 | −4.20 | −0.52 | −5.55 | −7.10 | −4.13 | +2.97 |
| 1.6 | −3.05 | −3.28 | −3.77 | −0.49 | −4.83 | −6.53 | −3.64 | +2.89 |
| 1.8 | −2.73 | −2.83 | −3.23 | −0.40 | −4.45 | −5.86 | −3.03 | +2.83 |

TABLE 3-continued

| | CIELAB a*-value | | | | CIELAB b*-value | | | |
|---|---|---|---|---|---|---|---|---|
| | SCOPIX ™ LT2B medical | Comparative experiment | | | SCOPIX ™ LT2B medical | Comparative experiment | | |
| $D_{vis}$ | hardcopy film | 2 | 3 | Δ3 − 2 | hardcopy film | 2 | 3 | Δ3 − 2 |
| 2.0 | −2.39 | −2.50 | −2.65 | −0.15 | −3.30 | −5.05 | −2.30 | +2.75 |
| 2.2 | −1.70 | −1.98 | −1.95 | +0.03 | −2.43 | −3.90 | −1.53 | +2.37 |
| 2.4 | −1.05 | −1.55 | −1.35 | +0.20 | −1.55 | −2.55 | −0.85 | +1.70 |
| 2.6 | −0.70 | −1.16 | −0.93 | +0.23 | −0.97 | −1.46 | −0.33 | +1.13 |
| 2.8 | −0.48 | −0.80 | −0.68 | +0.12 | −0.60 | −0.85 | +0.05 | +0.90 |

It was therefore surprising that prints produced in COMPARATIVE EXAMPLE 2 and INVENTION EXAMPLE 1 with the same substantially light-insensitive thermographic material but with different line times, 3.5 ms and 8.33 ms respectively, and different transport speeds, 14.3 mm/s and 9.53 mm/s respectively, had substantially identical CIELAB a*- and b*-values at all image densities. This has been surprisingly realized by changing the heating element aspect ratio from 1.50 to an aspect ratio between 0.25 and 0.88 i.e. 0.63.

An identical transport speed was used for the prints produced in COMPARATIVE EXPERIMENT 1 and INVENTION EXPERIMENT 1. Therefore the printing parameters for the prints produced with COMPARATIVE EXPERIMENT 1 and INVENTION EXPERIMENT 1 only differed in line time. However, as pointed out above, the image tone of a print produced with a pixel length in the transport direction no larger than the length of the heating element in the transport direction has a pixel length which increases with increasing line-time, but an image tone which is independent of the line time. Therefore, if image tones are being compared the printing parameters can be regarded as being comparable. Moreover, these prints were produced with thermal heads with heating elements with considerably different lengths in the transport direction of 140 μm and 50 μm respectively and considerably different image tones were exhibited. These experiments show that by reducing the length of the heating elements in the transport direction, there is virtually no effect on the CIELAB a*-values at all image densities, but that the CIELAB b*-values were dramatically affected being shifted to considerably more negative values over a large part of the $D_{vis}$ range i.e. the image became markedly bluer, with particularly high shifts of −3.73 and −3.40 being observed at optical densities critical to the perception of the observer i.e. the image tone of the print obtained in INVENTION EXAMPLE 1 is considerably more acceptable to image analysts than the image tone of the print obtained in COMPARATIVE EXAMPLE 1. The only substantial difference between the printing conditions of COMPARATIVE EXAMPLE 1 and INVENTION EXAMPLE 1 is the length of the heating elements in the transport direction or in other words the aspect ratios of the heating elements changing from 1.76 to 0.63. This again demonstrates the benefit of the use of heating elements with aspect ratios in the range of 0.25 to 0.88.

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A thermal head printer for printing a substantially light-insensitive thermographic material, said thermal printer comprising:

(a) a transport system having a transport direction, (b) n thermal heads, where n is an integer greater than zero, each of said thermal heads comprising an array of substantially rectangular energizable heating elements, said heating elements having a length $L_n$ in said transport direction and a pitch $P_n$ between adjacent heating elements, and (c) a means for supplying electrical energy to each of said substantially rectangular energizable heating elements in at least one of said thermal heads, wherein said transport system is capable of transporting said light-insensitive thermographic material in contact or proximity with at least one of said thermal heads, wherein at least one of said thermal heads comprises heating elements for which $L_nP_n$ is between 0.25 and 0.88, wherein said printer is capable of image-wise printing said substantially light-insensitive thermographic material, and wherein said substantially light-insensitive thermographic material is not perforated by said printer.

2. The thermal head printer according to claim 1, wherein said thermal head printer comprises a replaceable thermal head or set of thermal heads.

3. The thermal head printer according to claim 1, wherein said substantially rectangular heating element is a split resistor.

4. A process for printing a substantially light-insensitive thermographic material with a thermal head printer for printing a substantially light-insensitive thermographic material comprising:

(a) providing a thermal head printer which comprises (i) a transport system having a transport direction, (ii) n thermal heads, where n is an integer greater than zero, each of said thermal heads comprising an array of substantially rectangular energizable heating elements, said heating elements having a length $L_n$ in said transport direction and a pitch $P_n$ between adjacent heating elements, and (iii) a means for supplying electrical energy to each of said substantially rectangular energizable heating elements in at least one of said thermal beads, (b) choosing a thermal head, (c) providing said substantially light-insensitive thermographic material, (d) transporting said substantially light-insensitive thermographic material past said thermal head, and (e) image-wise heating of said substantially light-insensitive thermographic material by supplying electrical energy to said heating elements, wherein said transport system is capable of transporting said light-insensitive thermographic material in contact or proximity with at least one of said thermal heads, wherein at least one of said thermal heads comprises heating elements for which $L_n/P_n$ is between 0.25 and 0.88. and wherein said substantially light-insensitive thermographic material is not perforated by said printer.

5. The process according to claim 4, wherein said thermal head printer comprises a replaceable thermal head or set of thermal heads.

6. The process according to claim 4, wherein said substantially rectangular heating element is a split resistor.

7. A process for printing a substantially light-insensitive thermographic material at different printing speeds with a thermal head comprising heating elements without significant variation in image tone, wherein the length of said heating elements in the transport direction of said substantially light-insensitive thermographic material decreases with decreasing printing speed.

8. A process for printing a substantially light-insensitive thermographic material at different printing speeds with a different thermal head at each printing speed without significant variation in image tone, wherein each of said different thermal heads comprises heating elements with a different length in the transport direction of said substantially light-insensitive thermographic material, and wherein said length of said heating elements in the transport direction of said substantially light-insensitive thermographic material decreases with decreasing printing speed.

9. A thermal head printer for printing a substantially light-insensitive thermographic printing material comprising:

(a) a transport system having a transport direction, (b) n thermal heads, wherein n is an integer greater than zero, each of said thermal heads comprising an array of substantially rectangular energizable heating elements, each element comprising a resistor, said heating elements having a length $L_n$ in said transport direction and a pitch $P_n$ between adjacent heating elements, and (c) a means for supplying electrical energy to each of said substantially rectangular energizable hearing elements in at least one of said thermal heads, wherein said transport system is capable of transporting said light-insensitive thermographic material in contact or proximity with at least one of said at least two thermal heads, wherein at least one of said thermal heads comprises heating elements for which $L_n/P_n$ is between 0.25 and 0.88, wherein the width of a space between adjacent resistors along a line in the plane of said heating elements which bisects all the heating elements is 20% or less of $P_n$, wherein said printer is capable of image-wise printing said substantially light-insensitive thermographic material, and wherein said substantially light-insensitive thermographic material is not perforated by said printer.

10. The thermal head printer according to claim 9, wherein said thermal head printer comprises a replaceable thermal head or set of thermal heads.

11. The thermal head printer according to claim 9, wherein said substantially rectangular heating element is a split resistor.

12. A process for printing a substantially light-insensitive thermographic material using a thermal head printer comprising:

(a) providing a thermal head printer which comprises (i) a transport system having a transport direction, (ii) n thermal heads, wherein n is greater than zero, each of said thermal heads comprising an array of substantially rectangular energizable heating elements, each element comprising a resistor, said heating elements having a length $L_n$ in said transport direction and a pitch $P_n$ between adjacent heating elements, and (iii) a means for supplying electrical energy to each of said substantially rectangular energizable heating elements in at least one of said thermal heads, (b) choosing a thermal head, (c) providing said substantially light-insensitive thermographic material, (d) transporting said substantially light-insensitive thermographic material past at least one of said thermal heads, and (e) image-wise heating said substantially light-insensitive thermographic material by supplying electrical energy to said heating elements, wherein said transport system is capable of transporting said light-insensitive thermographic material in contact or proximity with at least one of said thermal heads, wherein at least one of said thermal heads comprises heating elements for which $L_n/P_n$ is between 0.25 and 0.88, wherein the width of a space between adjacent resistors along a line in the plane of said heating elements which bisects all the heating elements is 20% or less of $P_n$, and wherein said substantially light-insensitive thermographic material is not perforated by said printer.

13. The process according to claim 12, wherein said thermal head printer comprises a replaceable thermal head or set of thermal heads.

14. The process according to claim 12, wherein said substantially rectangular heating element is a split resistor.

15. A thermal head printer for printing a substantially light-insensitive thermographic material comprising:

(a) a transport system having a transport direction, (b) n thermal heads, wherein n is at least two, each of said thermal heads comprising an array of substantially rectangular energizable heating elements, said heating elements having a length $L_n$ in said transport direction and a pitch $P_n$ between adjacent heating elements, and (c) a means for supplying electrical energy to each of said substantially rectangular energizable heating elements in at least one of said thermal heads, wherein said transport system is capable of transporting said light-insensitive thermographic material in contact or proximity with at least one of said at least two thermal heads, wherein at least one of said at least two thermal heads comprises heating elements for which $L_n/P_n$ is between 0.25 and 0.88, wherein said substantially light-insensitive thermographic material is not perforated by said printer, and wherein said at least two thermal heads are configured such that a first thermal head can be replaced by an nth thermal head while being capable of maintaining a comparable image tone with said substantially light-insensitive thermographic material.

16. A process for printing a substantially light-insensitive thermographic material using a thermal head printer comprising:

(a) providing a thermal head printer which comprises (i) a transport system having a transport direction, (ii) n thermal heads, wherein n is at least two, each of said thermal heads comprising an array of substantially rectangular energizable heating elements, said heating elements having a length $L_n$ in said transport direction and a pitch $P_n$ between adjacent heating elements, and (iii) a means for supplying electrical energy to each of said substantially rectangular energizable heating elements in at least one of said thermal heads, (b) choosing a thermal head, (c) providing said substantially light-insensitive thermographic material, (d) transporting said substantially light-insensitive thermographic material past said thermal head, and (e) image-wise heating said substantially light-insensitive thermographic material by supplying electrical energy to said heating elements, wherein said transport system is capable of transporting said light-insensitive thermographic material in contact or proximity with at least one of said thermal heads, wherein at least one of said thermal heads comprises heating elements for which $L_n/P_n$ is between 0.25 and 0.88, wherein a first thermal head can be replaced by an nth thermal head while being capable of maintaining a comparable image tone with said substantially light-insensitive thermographic material, and wherein said substantially light-insensitive thermographic material is not perforated by said printer.

* * * * *